US006553963B1

(12) United States Patent
Noble

(10) Patent No.: US 6,553,963 B1
(45) Date of Patent: Apr. 29, 2003

(54) THROTTLE ASSEMBLY WITH OIL SEAL BUSHING

(75) Inventor: Mark Noble, Pleasant Prairie, WI (US)

(73) Assignee: Bombardier Motor Corporation of America, Grant, FL (US)

( * ) Notice: Subject to any disclaimer, the term of this patent is extended or adjusted under 35 U.S.C. 154(b) by 25 days.

(21) Appl. No.: 09/690,608

(22) Filed: Oct. 17, 2000

(51) Int. Cl.[7] ..... F02D 9/08
(52) U.S. Cl. ..... 123/337; 251/305
(58) Field of Search ..... 123/337, 399, 123/396, 336, 73 AV, 73 V, 403, 579, 580; 251/305, 129.11, 314

(56) References Cited

U.S. PATENT DOCUMENTS 3,700,246 A * 10/1972 Enarsson ..... 277/350
4,220,124 A * 9/1980 Morris et al. ..... 123/391
4,660,996 A * 4/1987 Marshall ..... 384/125
4,757,792 A * 7/1988 Flaig et al. ..... 123/437
4,981,284 A * 1/1991 Imamura et al. ..... 251/305
5,730,099 A 3/1998 Gillespie
5,875,745 A * 3/1999 Watanabe et al. ..... 123/59.5
5,992,378 A 11/1999 Parkinson
6,026,770 A * 2/2000 Ueda et al. ..... 123/196 R

FOREIGN PATENT DOCUMENTS

JP 10-47088 * 2/1998 ..... F02D/9/10
JP 10-103088 * 4/1998 ..... F02D/9/10
JP 10-252508 * 9/1998 ..... F02D/9/10

* cited by examiner

*Primary Examiner*—John Kwon
*Assistant Examiner*—Hieu T. Vo

(57) ABSTRACT

A throttle assembly for an internal combustion engine includes a throttle body that defines an airflow passage, a throttle shaft rotatably mounted to the throttle body and extending though the airflow passage, a throttle plate coupled to the throttle shaft, and a seal member coupled to the throttle shaft. More specifically, one end of the throttle shaft extends through the throttle body, and a seal member surrounds the throttle shaft between the throttle body and the shaft. The seal member extending into the airflow passage and effectively forms a standpipe extending into the airflow passage for a length sufficient to prevent pooled engine fluid from seeping out of said throttle body along said throttle shaft.

20 Claims, 4 Drawing Sheets

THROTTLE ASSEMBLY WITH OIL SEAL BUSHING

BACKGROUND OF THE INVENTION

This invention relates generally to internal combustion engines, and, more specifically, to throttle assemblies including vertically mounted throttle shafts that regulate air intake into the engine cylinders.

Conventional internal combustion engines that, for example, power an outboard motor typically include a plurality of throttle plates mounted to an engine cranckcase to regulate an amount of air delivered to each cylinder of the engine. A throttle linkage typically connects the throttle shafts of the throttle valves to substantially synchronize the position of the throttle plates to stabilize engine operation, and a throttle actuator adjusts the positions of the plates to allow adjustment of airflow into the cylinders.

In one type of throttle assembly, each of the throttle plates is mounted to a throttle shaft rotatably mounted to the throttle body and extending through the throttle body. The throttle body defines a generally cylindrical airflow passage, and the throttle plates are also substantially circular so as to substantially restrict air from flowing through the airflow passage when the throttle plates are in a closed position, thereby allowing a minimum amount of airflow into the cylinders, and to allow a maximum amount of air into the engine cylinders when in a fully open position. See, for example, U.S. Pat. No. 5,992,378. The throttle plate is spring biased toward the closed position, and the throttle actuator opens the throttle plates against the bias of the spring.

In some engines, such as in certain outboard motor systems, it is desirable to mount the throttle shafts vertically instead of horizontally. In such systems, however, it has been observed that lubrication oil and/or other engine fluids tend to pool in the bottom of the cylindrical air passages. The pooled fluid tends to seep along the throttle shaft extending through the throttle body to the outside of the throttle body and drips onto exterior surfaces of the motor. This fluid seepage is undesirable for reasons that are apparent.

BRIEF SUMMARY OF THE INVENTION

In an exemplary embodiment, a throttle assembly for an internal combustion engine includes a throttle body that defines an airflow passage, a throttle shaft rotatably mounted to the throttle body and extending though the airflow passage, a throttle plate coupled to the throttle shaft, and a seal member coupled to the throttle shaft. More specifically, one end of the throttle shaft extends through the throttle body, and a seal member surrounds the throttle shaft between the throttle body and the shaft. The seal member extends into the airflow passage and effectively forms a standpipe extending into the airflow passage for a length sufficient to prevent pooled engine fluids from seeping out of said throttle body along the throttle shaft.

In a further embodiment, the seal member is a bushing that surrounds a vertically mounted throttle shaft and is press fit into the throttle body so that the bushing is partially located between the throttle body and the shaft, and partially located in the airflow passage. The bushing extends upward from the throttle body into the airflow passage, but does not extend to the throttle plate. Therefore, the throttle plate is separated from the bushing and is free to rotate within the airflow passage as the throttle shaft is moved with a throttle actuator.

To accommodate the seal member, the throttle plate includes an outer periphery having a first portion and a second portion. One of the portions is curved and continuous and substantially complementary in shape to the airflow passage, and the other portion is discontinuous relative to the curved portion and, in one embodiment, is substantially flat to provide a clearance for the bushing.

A cost effective, leak proof throttle assembly is therefore provided that is particularly advantageous for outboard motor systems.

DETAILED DESCRIPTION OF THE INVENTION

Figure 1:
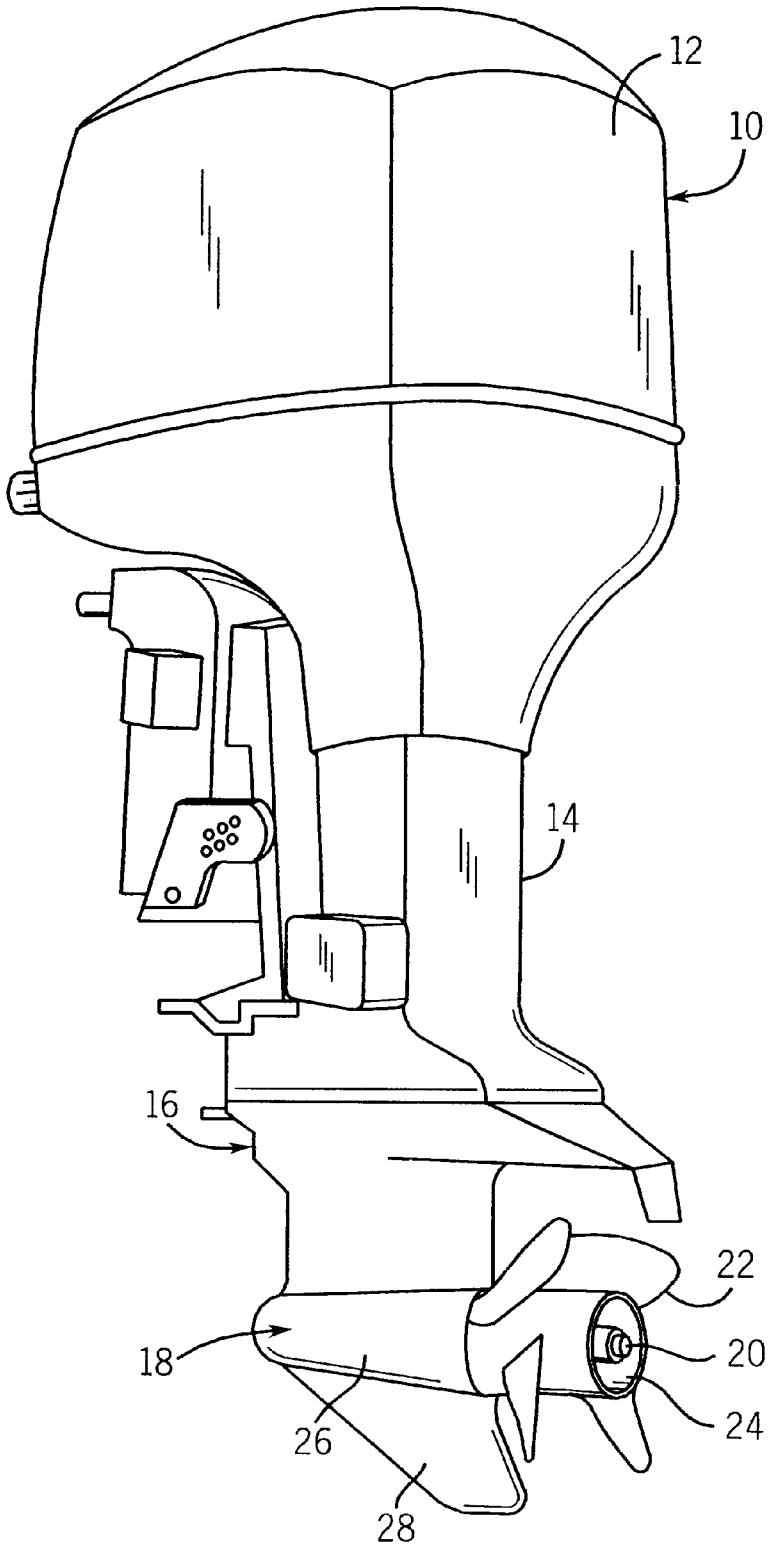
FIG. 1 PRIOR ART
FIG. 1 is a perspective view of an exemplary outboard motor.

FIG. 1 is a perspective view of an exemplary outboard motor 10, such as an outboard engine commercially available from Outboard Marine Corporation, Waukegan, Ill. Motor 10 includes a cover 12 which houses a power head (not shown), an exhaust housing 14, and a lower unit 16. Lower unit 16 includes a gear case 18 which supports a propeller shaft 20. A propeller 22 is engaged to shaft 20. Propeller 22 includes an outer hub 24 through which exhaust gas is discharged. Gear case 18 includes a bullet, or torpedo, 26 and a skeg 28 which depends vertically downwardly from torpedo 26.

The power head includes an internal combustion engine (not shown in FIG. 1) having a drive shaft (not shown) which engages a gear set in gear case 18 and causes propeller shaft 20 to rotate. As propeller shaft 20 rotates, a thrust is developed to propel a watercraft (not shown) or vessel to which outboard motor 10 is attached. An air intake system (not shown in FIG. 1) includes an air inlet (not shown in FIG. 1) in flow communication with the atmosphere for intake combustion air for the cylinders of the engine. Air is passed into each of the engine cylinders through a throttle assembly (not shown in FIG. 1) and fuel is directly injected into the engine cylinders for combustion.

Figure 2:
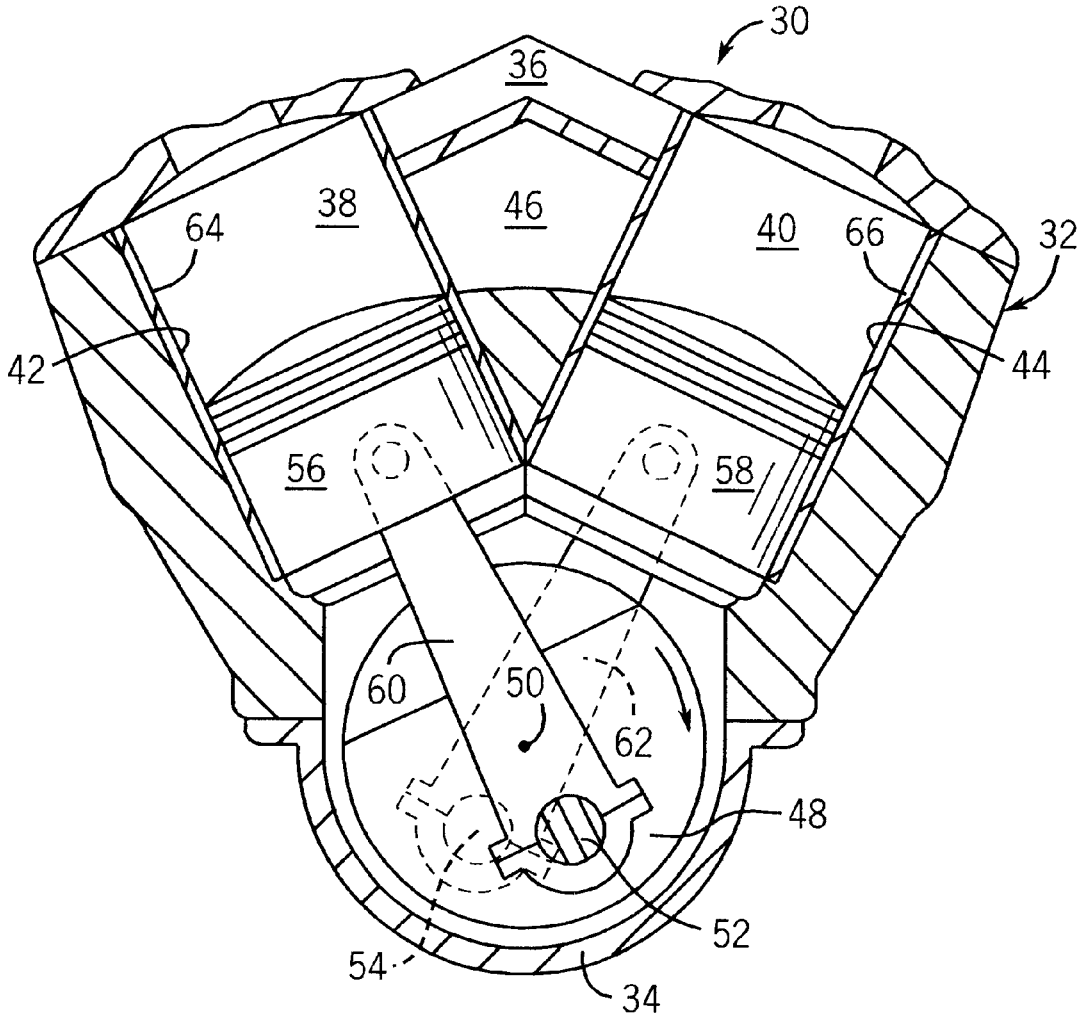
FIG. 2 PRIOR ART
FIG. 2 is a schematic, partial cross-sectional illustration of a known internal combustion engine for the outboard motor shown in FIG. 1.

FIG. 2 is a schematic, partial cross sectional illustration of a portion of a known direct-injected internal combustion engine 30 for marine use, such as, for example, for use with outboard motor 10 (shown in FIG. 1). Engine 30 includes a cylinder block 32 having a crankcase 34. Cylinder block 32 also includes a main exhaust passageway 36 intermediate first and second cylinders 38 and 40 which extend radially from crankcase 34. Cylinders 38 and 40 include cylinder walls 42 and 44, respectively. Block 32 further includes a water passageway 46 intermediate cylinders 38 and 40.

A crankshaft 48 is supported in crankcase 34 for rotation about a crankshaft axis 50. Angularly spaced first and second crankpins 52 and 54 are coupled to crankshaft 48. Pistons 56 and 58 are connected to crankpins 52 and 54 by connecting rods 60 and 62. Pistons 56 and 58 are reciprocally movable in first and second cylinders 38 and 40 toward and away from crankshaft 48 and between top dead center and bottom dead center positions. Sleeves 64 and 66 are located in cylinders 42 and 44, and pistons 56 and 58 are in sliding contact with sleeves 64 and 66.

Figure 3:
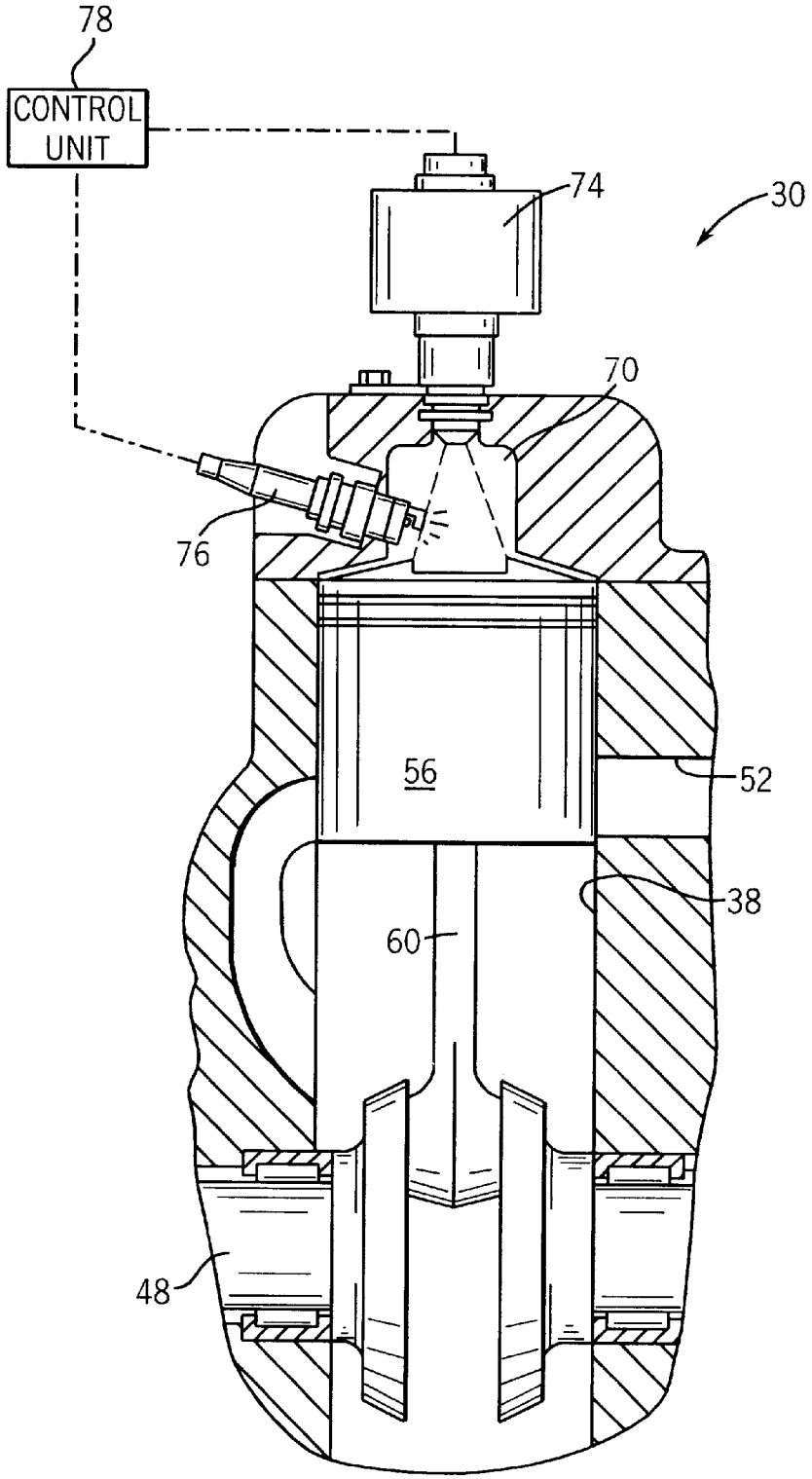
FIG. 3 PRIOR ART
FIG. 3 is a schematic illustration of an cylinder of the engine shown in FIG. 2.

FIG. 3 illustrates, in more detail, cylinder 38 of engine 30. Cylinder 38 includes a combustion chamber 70, and an exhaust manifold 72 communicates with combustion chamber 70. A fuel injector 74 communicates directly with combustion chamber 70 and periodically injects fuel unmixed with air directly in chamber 70. A spark plug 76 extends into combustion chamber 70, and is operable to periodically ignite the fuel charges in combustion chamber 70. A control unit 78, which in one embodiment includes an electronic control unit (ECU), controls operations of injector 74 and spark plug 76. Additional details regarding the above described engine components are set forth, for example, in U.S. Pat. No. 5,730,099, which is assigned to the present assignee.

Engine 30 is shown schematically and primarily to describe one known engine configuration. The present invention is not limited to practice in engine 30, and can be used in connection with other engine arrangements, including but not limited to inboard engines for marine use For example, although the present invention is described herein in connection with a single fluid, pressure surge direct in-cylinder fuel injection system, the invention can be used in connection with other fuel injection systems including, for example, dual fluid, air-assisted direct in-cylinder fuel injection systems. In addition, the present invention is equally applicable to four cylinder and six cylinder two stroke and four stroke engines. Still further, the invention may be used with carburated engine systems. Therefore, the benefits of the present invention accrue generally to any engine wherein engine fluid leakage, including but not limited to lubrication oil and engine fuel, from a throttle assembly is undesirable. Consequently, the present invention is not limited to practice in connection with marine applications.

Figure 4:
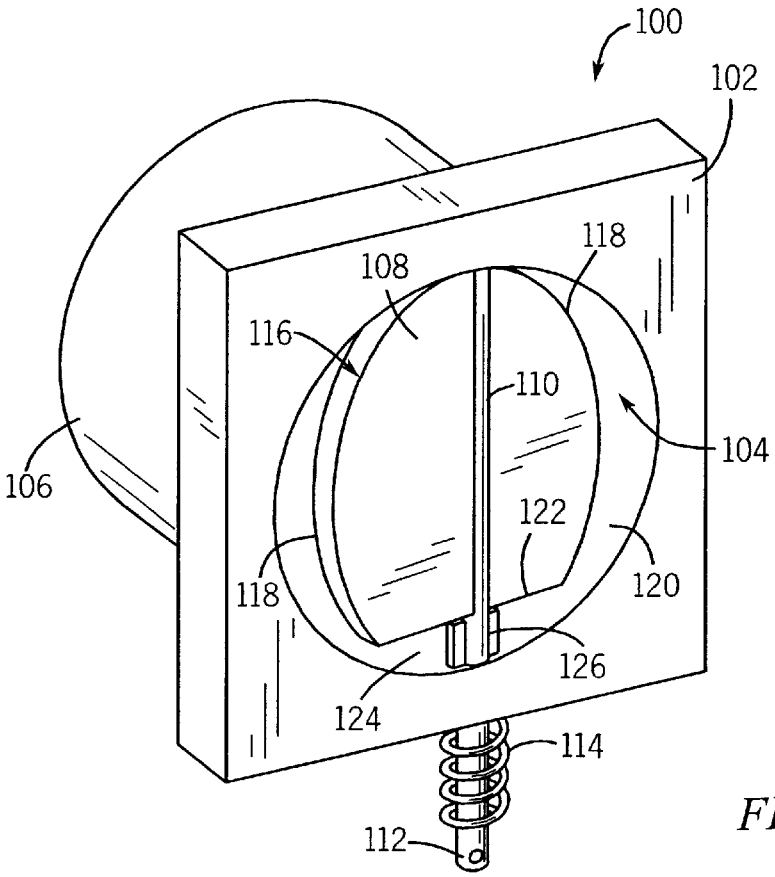
FIG. 4 is a perspective view of a throttle assembly for use with the engine shown in FIGS. 2 and 3 and in an open position.

FIG. 4 is a perspective view of an exemplary throttle assembly 100 for use with, for example, cylinder 38 (shown in FIG. 3) and for regulating airflow into cylinder 38 from an air intake manifold (not shown). Throttle assembly includes a throttle body 102 including an airflow passage 104 therethrough, and a throat 106 extends from a forward end of throttle body 102 and is configured for connection and coupling to an air intake manifold or air inlet (not shown) according to methods known in the art. Likewise, throttle body 102 is coupled to an engine crankcase in flow communication with an engine cylinder, such as cylinder 38, according to known methods such that airflow passage 104 is in flow communication with engine cylinder 38. Airflow passage 104 extends through throttle body 102 and throat 106 and, in operation, combustion air flows from the air intake manifold, through throat 106 and through throttle body 102 via airflow passage 104 and into the engine cylinder.

A throttle valve or throttle plate 108 is situated in throttle body 102, and more specifically, in airflow passage 104. Throttle plate 108 is selective positionable between an open position (shown in FIG. 4) and a closed position (shown in FIG. 5) via actuation of a throttle shaft 110 that is rotatably mounted to throttle body 102 and coupled to throttle shaft 108.

Throttle shaft 110 is substantially vertically mounted to throttle body 102 so that throttle shaft 110 is substantially vertically oriented when throttle body 102 is attached to the engine crankcase. Throttle shaft 110 is supported by bearings (not shown) in throttle body 102 that facilitate rotation of throttle shaft 110 relative to throttle body 102. A lower end 112 of throttle shaft 110 extends through throttle body 102, and a bias member, such as a spring 114 biases throttle shaft to a predetermined position, such as a closed position, explained further below.

Throttle plate 108 includes an outer periphery 116 including a first portion 118 that is substantially complementary in shape to an inner periphery 120 of airflow passage 104, and a second portion 122 that is dissimilar in shape to airflow passage inner periphery 120. In the illustrated embodiment, airflow passage inner periphery 120 is substantially cylindrical, and throttle plate outer periphery first portion 118 is substantially circular and dimensioned to substantially occupy the entire area of airflow passage 104 when throttle plate 108 is in a closed position, but when throttle plate 108 is rotated into the open position, throttle plate outer periphery first portion 118 is substantially separated from airflow passage inner periphery, thereby allowing substantial airflow through airflow passage 104.

In contrast, throttle plate outer periphery second portion 122 is substantially linear or flat, and consequently not complementary in shape to airflow passage inner periphery 120. Because throttle plate outer periphery second portion does not share the curvature of airflow passage inner periphery 120, a clearance or gap 124 is created between airflow passage inner periphery 120 and throttle plate outer periphery second portion 122 in both the opened and closed positions. A seal member 126 extends into gap 124 and prevents pooled oil, lubrication fluid, or other engine fluids from seeping out of throttle body 102 along throttle shaft first end 112.

In alternative embodiments, other substantially complementary shapes, including non-curved shapes, of throttle plate outer periphery first portion 108 and airflow passage inner periphery are used to produce a throttle plate that substantially blocks or restricts airflow through airflow passage 104 when in a closed position. In a further alternative embodiment, throttle plate outer periphery second portion 122 need not be flat, but rather has any shape, curved or non-curved, relative to airflow passage inner periphery 120 to produce gap 124 to accommodate seal member 126.

When throttle body 102 is attached to an engine crankcase, throttle shaft first end 112 is coupled to a linkage (not shown) which in turn is coupled to an actuator (not shown) that causes rotation of throttle shaft 110, and hence attached throttle plate 108. As throttle plate 108 is moved from the closed position to the open position (shown in FIG. 4), more air is allowed into the engine cylinder and the greater the combustion therein. As throttle plate 108 is moved from the open position to the closed position, less air is allowed into the engine cylinder and the lesser the combustion therein. Throttle plate 108 is naturally biased to a closed position via spring 114 and is positionable at intermediate positions between the open and closed position in response to a user selected throttle setting.

Figure 5:
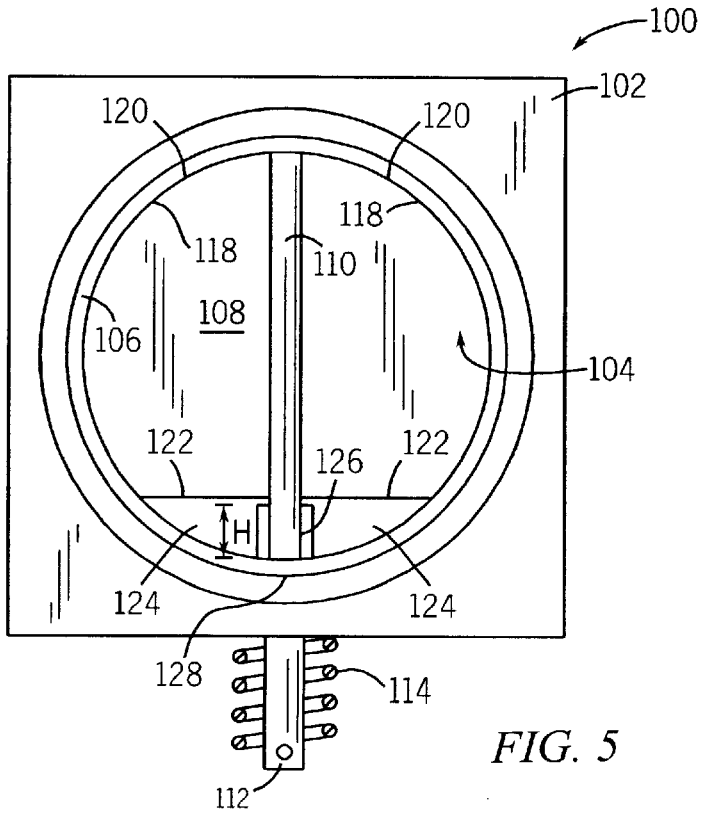
FIG. 5 is a front plan view of the throttle assembly shown in FIG. 4 in a closed position.

FIG. 5 is a front plan view of throttle assembly 102 shown in the closed position. Throttle plate 108 substantially blocks airflow passage 104, and throttle plate outer periphery first portion 118 is substantially contiguous to airflow passage inner periphery 120. Throttle plate outer periphery second portion 122 extends above a lower portion of airflow passage inner periphery 120 to create gap 124.

Seal member 126 projects upwardly into airflow passage 104 from a lowest point 128 of airflow passage inner periphery 120 and effectively forms a standpipe seal that prevents pooled engine fluid from seeping out of throttle body 102. Seal member 126 extends a height H (measured radially) above airflow passage inner periphery 120, that is pre-selected to be greater than a depth of oil, lubricants, fuel or other engine fluids in the vicinity of seal member 126. In an exemplary embodiment H is about 0.06 inches to about 0.09 inches. However, seal member does not extend to throttle plate outer periphery second portion 122, i.e., throttle plate 108 is separated from seal member 126 so that seal member 126 does not impede rotation of throttle plate 108.

Seal member 126 surrounds throttle shaft 108 and is press-fit into throttle body 102, and therefore at least partly extends into throttle body 102 between throttle body 102 and throttle shaft 110 to form a sealed barrier and prevent fluids from seeping through throttle body 102 along throttle shaft 110. In one embodiment, seal member is an appropriately dimensioned rubber bushing, such as those available from Igus Inc. of East Providence, Rhode Island, and in particular is an Iglide J Sleeve fabricated from material JSI 05056-08. In other embodiments, other seal members, including but not limited to bushings, are employed that are fabricated from other wear resistant materials that are non-reactant to oil, fuel or other lubricants and engine fluids encountered in use with internal combustion engines.

A cost effective and easily manufactured sealed throttle assembly is therefore provided to contain engine fluids and lubricants inside the throttle body. The throttle assembly is therefore particularly suited for outboard motor applications, but is also well suited for other engine applications.

While the invention has been described in terms of various specific embodiments, those skilled in the art will recognize that the invention can be practiced with modification within the spirit and scope of the claims.

What is claimed is:

1. A throttle assembly for an internal combustion engine, said throttle assembly comprising:

a throttle body at least partially defining an airflow passage;

a throttle shaft rotatably mounted to said throttle body and extending though said airflow passage, said throttle shaft having at least one end extending through said throttle body;

a throttle plate coupled to said throttle shaft; and a seal member surrounding said throttle shaft end between said throttle body and said shaft, said seal member extending into said airflow passage.

2. A throttle assembly in accordance with claim 1 wherein said seal member comprises a bushing.

3. A throttle assembly in accordance with claim 2 wherein said throttle shaft is vertically mounted to said throttle body.

4. A throttle assembly in accordance with claim 3 wherein said airflow passage is substantially cylindrical.

5. A throttle assembly in accordance with claim 4 wherein said throttle plate is separated from said bushing along said throttle shaft.

6. A throttle assembly in accordance with claim 5 wherein said throttle plate is substantially circular.

7. A throttle assembly in accordance with claim 1 wherein said throttle plate comprises an outer periphery comprising a first portion and a second portion, said first portion discontinuous from said second portion.

8. A throttle assembly in accordance with claim 1 wherein said bushing extends into said airflow passage for a length to prevent pooled engine fluid from seeping out of said throttle body along said throttle shaft.

9. A throttle assembly for an internal combustion engine, said throttle assembly comprising:

a throttle body comprising an airflow passage therethrough, said airflow passage comprising an inner periphery;

a throttle plate situated in said airflow passage and selectively positionable between a closed position and an open position, said throttle plate comprising an outer periphery comprising a first portion and a second portion, said first portion separated from said inner periphery of said airflow passage when said throttle plate is in said open position and when said throttle plate is in said closed position; and a throttle shaft rotatably coupled to said throttle plate and rotatably mounted to said throttle body; and a seal member coupled to said shaft and extending between said throttle plate first portion and said airflow passage.

10. A throttle assembly in accordance with claim 9 wherein said seal member comprises a bushing.

11. A throttle assembly in accordance with claim 10 wherein said first portion of said outer periphery is separated from said bushing.

12. A throttle assembly in accordance with claim 11 wherein said throttle shaft is substantially vertically mounted.

13. A throttle assembly in accordance with claim 12 wherein said throttle shaft extends through said throttle body, said bushing surrounding said shaft and extending into said airflow passage.

14. A throttle assembly in accordance with claim 9 wherein said inner periphery is substantially cylindrical.

15. A throttle assembly in accordance with claim 9 wherein said outer periphery first portion is substantially linear.

16. A throttle assembly in accordance with claim 9 wherein said outer periphery second portion is substantially circular.

17. A throttle assembly for an internal combustion engine, said throttle assembly comprising:

a throttle body comprising an airflow passage, said airflow passage comprising an inner periphery;

a substantially vertical throttle shaft rotatably mounted to said throttle body and extending through said airflow passage, said throttle shaft comprising a first end extending through said throttle body;

a throttle plate coupled to said throttle shaft for regulating airflow through said air passage, said throttle plate having an outer periphery, said outer to periphery substantially complementary to said inner periphery; and a seal member surrounding said throttle shaft and extending between said throttle shaft and said throttle body, said seal member further extending into said airflow passage, said seal member separated from said throttle plate.

18. A throttle assembly in accordance with claim 17 wherein said seal member forms a standpipe to prevent pooled engine fluid from seeping out of said throttle body along said first end of said throttle shaft.

19. A throttle assembly in accordance with claim 18 wherein said seal member comprises a bushing.

20. A throttle assembly in accordance with claim 19 wherein said bushing extends into said passage for a length of about 0.09 inches.

* * * * *